US005080512A

United States Patent [19]

Schofield et al.

[11] Patent Number: 5,080,512

[45] Date of Patent: Jan. 14, 1992

[54] APPARATUS AND METHOD FOR PRINTING INCLUDING SLIDE MECHANISM

[75] Inventors: Harold Schofield, Narragansett; Edward A. Nardone, Wakefield; Paul Caron, Tiverton, all of R.I.

[73] Assignee: Datacard Corporation, Minneapolis, Minn.

[21] Appl. No.: 482,794

[22] Filed: Feb. 21, 1990

[51] Int. Cl.[5] ..... B41J 33/16

[52] U.S. Cl. ..... 400/225; 400/120; 400/223; 400/240

[58] Field of Search ..... 400/120, 240, 240.3, 400/223, 225, 226, 231, 234, 235, 236, 236.1, 236.2, 240.4, 622, 621, 623, 578, 601, 607; 346/76 PH, 106

[56] References Cited

U.S. PATENT DOCUMENTS

| | | | |
|---|---|---|---|
| 3,735,907 | 5/1973 | Kuchar | 226/150 |
| 3,819,073 | 6/1974 | Asselhorn et al. | 226/162 |
| 4,015,700 | 4/1977 | Paque | 400/617 |
| 4,119,254 | 10/1978 | Lorenz | 226/112 |
| 4,202,637 | 5/1980 | Tummolo | 400/118 |
| 4,209,120 | 6/1980 | Ruegg et al. | 226/32 |
| 4,270,684 | 6/1981 | Cauffiel | 226/162 |
| 4,456,226 | 6/1984 | Stumpmeier | 226/162 |
| 4,458,253 | 7/1984 | Goff et al. | 400/120 |
| 4,493,447 | 1/1985 | Ledgerwood | 226/162 |
| 4,505,603 | 3/1985 | Yana | 400/120 |
| 4,551,729 | 11/1985 | Kubo et al. | 400/240.3 |
| 4,552,470 | 11/1985 | Yana et al. | 400/120 |
| 4,562,443 | 12/1985 | Matsuno et al. | 346/76 PH |
| 4,594,597 | 6/1986 | Liu et al. | 346/76 PH |
| 4,647,234 | 3/1987 | Isobe | 400/120 |
| 4,657,418 | 4/1987 | Lahr et al. | 400/225 |
| 4,695,175 | 9/1987 | Tsukada et al. | 400/196.1 |
| 4,747,715 | 5/1988 | Lahr | 400/234 |

FOREIGN PATENT DOCUMENTS

| | | | |
|---|---|---|---|
| 58-193184 | 11/1983 | Japan . | |
| 59-31170 | 2/1984 | Japan . | |
| 15176 | 1/1985 | Japan | 400/240.3 |
| 236779 | 11/1985 | Japan | 400/240.3 |
| 61-158481 | 7/1986 | Japan . | |
| 62-193861 | 8/1987 | Japan . | |
| 62-227673 | 10/1987 | Japan . | |
| 63-135264 | 6/1988 | Japan . | |

*Primary Examiner*—David A. Wiecking
*Assistant Examiner*—Joseph R. Keating
*Attorney, Agent, or Firm*—Merchant, Gould, Smith, Edell, Welter & Schmidt

[57] ABSTRACT

A printer apparatus including a slide assembly for advancing a receptor material and a ribbon material relative to a print head and platen for printing color images.

10 Claims, 12 Drawing Sheets

APPARATUS AND METHOD FOR PRINTING INCLUDING SLIDE MECHANISM

BACKGROUND OF THE INVENTION

The present invention relates to a printer apparatus and method for color printing, including a threaded screw driven slide apparatus and method for reciprocally moving a receptor material and a print head of the printer apparatus relative to one another during the printing process.

When printing a colored image onto a receptor material such as a plastic card or the like, three primary colors are typically used to create the composite color image. This is typically accomplished in three separate passes using a print head to print the first primary color from a ribbon onto the receptor material, then the second primary color from a ribbon onto the receptor material, and then the third primary color from the ribbon onto the receptor material. Typically, this is accomplished by moving the receptor material by use of a bi-directional tractor feed, if the receptor material is continuous, or by use of rotating drums, if the receptor material is feed one sheet at a time. A problem encountered with these methods and others is being able to accurately line up the printing of each color on the receptor material during each pass so that the image has the desired clarity and resolution and is not smeared or smudged. This is difficult to accomplish when printing images very quickly.

The present invention solves these problems and others associated with the prior art.

SUMMARY OF THE INVENTION

The present invention relates to an improved printer apparatus, including receptor material supply means for supplying a receptor material;

ribbon supply means for supplying a ribbon material, the ribbon material including a plurality of different colored sections, reoccurring in a repetitive pattern;

a print head and platen arrangement, the receptor material and the ribbon material extending intermediate of the print head and the platen in a juxtaposed relationship with the print ribbon being disposed intermediate of the receptor material and the print head; and means for moving the receptor material;

self driven ribbon material takeup roller assembly advancing the ribbon material including slip clutch drive means for advancing the ribbon material during the printing process and direct drive means bypassing the slip clutch means for advancing the ribbon material from one colored section to the next.

In one embodiment, the self driven ribbon material takeup roller assembly includes a solenoid motor for driving a roller shaft of the ribbon material takeup roller assembly. A slip clutch arrangement interconnects the roller shaft to the solenoid motor.

In one embodiment, control means is present for varying the rate of takeup of the ribbon material by the ribbon material takeup roller assembly.

One embodiment includes sensor means for sensing speed at which the ribbon material is being advanced by the ribbon material takeup roller when the ribbon material is advanced from one color section to the next, the control means being electrically connected to said sensor means for receiving electrical signals from the sensor means representative of the speed at which the ribbon material is being advanced by the ribbon material takeup roller assembly, the control means including program means for processing the electrical signals and determining the rate at which the ribbon material takeup roller assembly should be rotated.

These and various other advantages and features of novelty which characterize the invention are pointed out with particularity in the claims annexed hereto and forming a part hereof. However, for a better understanding of the invention, its advantages, and the objects obtained by its use, reference should be made to the accompanying drawings and descriptive matter, which form a further part hereof, and in which there is illustrated and described a preferred embodiment of the invention.

BRIEF DESCRIPTION OF THE FIGURES

In the figures wherein like reference numerals indicate corresponding parts throughout the several views.

DETAILED DESCRIPTION OF A PREFERRED EMBODIMENT OF THE INVENTION

Figure 1:
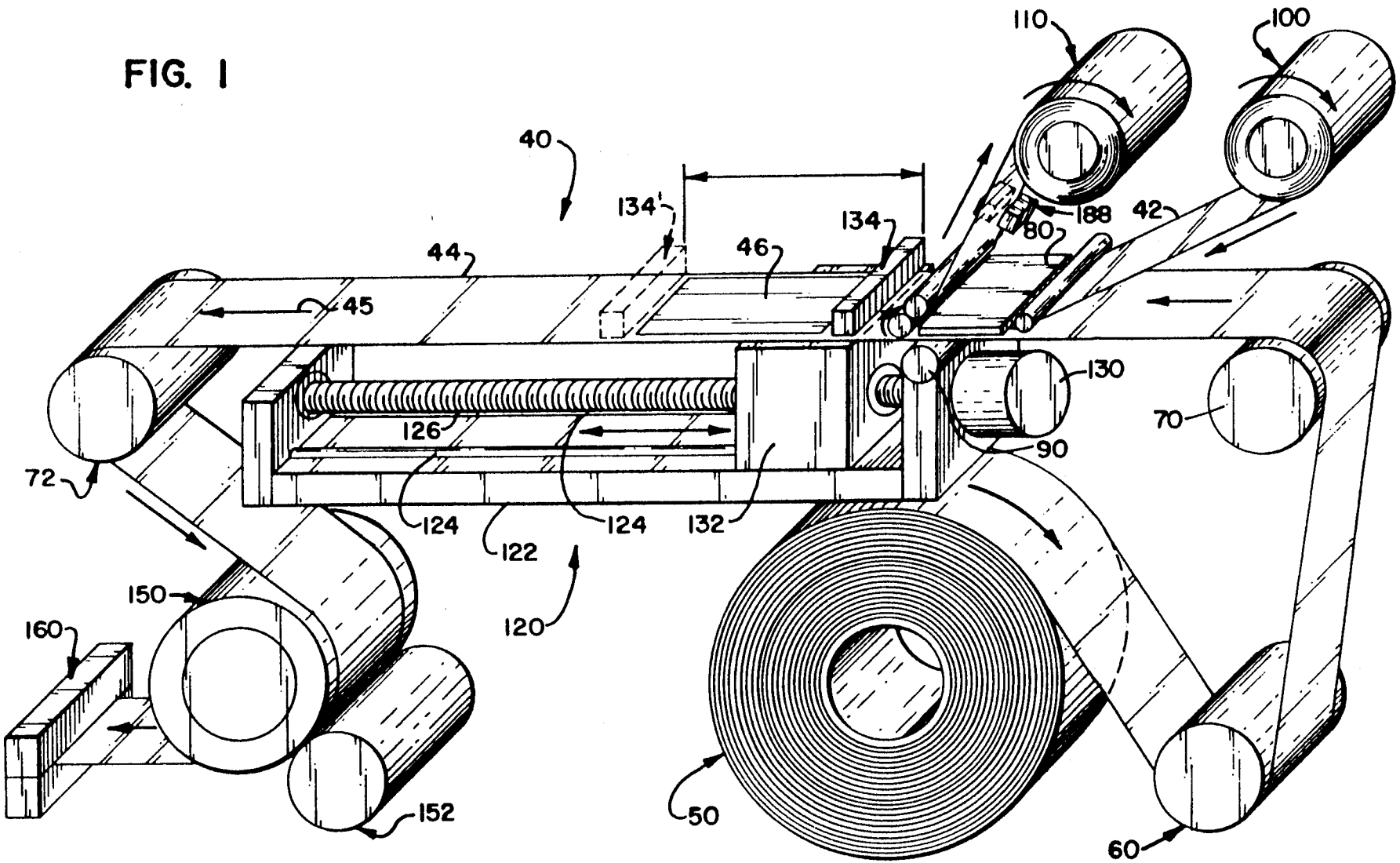
FIG. 1 is a diagrammatic side elevational view of an embodiment of a printer apparatus in accordance with the principles of the present invention.
Figure 2:
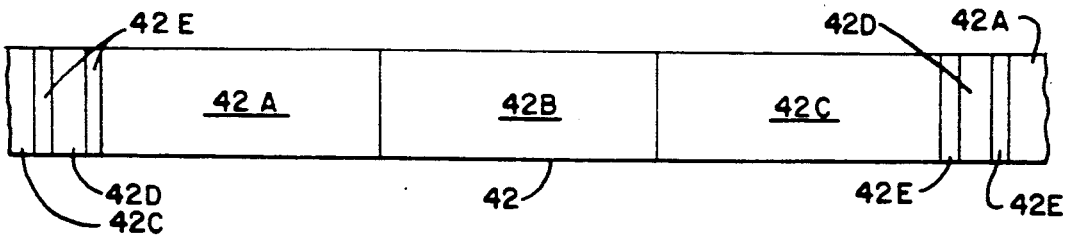
FIG. 2 is a diagrammatic top plan view of an embodiment of ribbon material used with the embodiment of the printer apparatus illustrated in FIG. 1.
Figure 4:
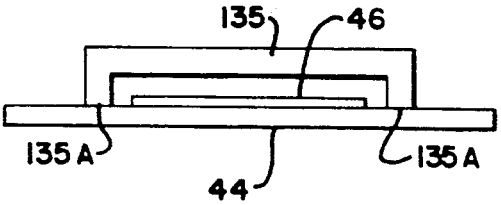
FIG. 4 is a diagrammatic view illustrating a clamp portion of the slide assembly illustrated in FIG. 3.
Figure 5:
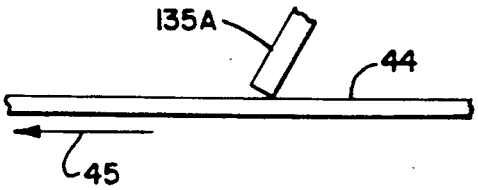
FIG. 5 is a diagrammatic view illustrating engagement of the clamp portion with a receptor material.

Illustrated in FIG. 1, is a diagrammatic illustration of a thermal printer apparatus, generally referred to by the reference numeral 40, in accordance with the principles of the present invention. The printer apparatus 40 causes color transfer from a ribbon material 42, an embodiment of which is shown in FIG. 2, having a plurality of different colored sections reoccurring in a predetermined pattern longitudinally of the ribbon material 42, to a receptor material 44 so as to form graphic images on the receptor material 44. The receptor material 44 is fed from a supply of receptor material which includes a receptor material payoff roller assembly 50. Tension in the receptor material 44 is maintained by a dancer roller assembly 60 which forces against the receptor material 44. The receptor material 44 is guided by a guide roller assembly 70 so as to pass intermediate of a print head 80 and an associated platen 90 in juxtaposed relationship with the ribbon material 42. As further illustrated in FIG. 3, the ribbon material 42 is fed from a ribbon payoff roller assembly 100, past a guide roller assembly 102, intermediate the receptor material 44 and the print head 80, past a guide roller assembly 104, and onto a ribbon takeup roller assembly 110. As further illustrated in FIG. 7, a guide roller assembly 119 is present to insure proper alignment of the receptor material 44 relative to the print head 80 and the platen 90.

Referring now to FIGS. 1-7, the receptor material 44 is clamped onto a slide assembly 120 which reciprocally moves the receptor material 44 back and forth relative to the print head 80 and the platen 90 a predetermined number of times, the printer head 80 being raised off the platen 90 when the receptor material in moved in an upstream direction and being lowered onto the platen 90 when the receptor material is moved in a downstream direction, the downstream direction being generally designated by an arrow 45. As the receptor material 44 is advanced in the downstream direction 45, the ribbon material 42 is advanced with the receptor material 44 at the same rate. Accordingly, a different colored section of the ribbon material 42 is advanced along with the receptor material 44 past the print head 80 with each advance of the receptor material 44 in the downstream direction past the print head 80. The printer head 80 is activated with each pass of the receptor material 44 and the associated ribbon material 42 in the downstream direction 45 such that colors are transferred from multiple colored sections of the ribbon material 42 onto the same section of the receptor material 44 such that a colored image is printed on a print area 46 of the receptor material 44.

Upon completion of printing the colored image on the print area 46, the print head 80 is deactivated and raised off the platen 90, and the receptor material 44 is advanced in the downstream direction 45 past a guide roller assembly 72 by a receptor material drive roller assembly 150 operating in conjunction with a friction roller assembly 152. In the embodiment shown, a cutter apparatus 160 is shown for cutting of a section of the receptor material 44 where an image has been formed although the receptor material 44 need not necessarily be cut by the printer apparatus 40.

The slide assembly 120, as shown in FIGS. 1-7, includes a slide base 122 having rail members 124 mounted thereon. A threaded screw 126 is rotatably mounted by a mounting assembly 128 at one end on the slide assembly 120 and rotatably driven by a stepper motor 130 at an opposite end of the slide assembly 120. In one embodiment, ten steps of the stepper motor 130 equals one dot line of the print head 80. A slide block 132 is threadably mounted on the screw 126 for movement along the slide base 122 in first and second directions upon rotation of the screw 126 in first and second directions, respectively, by the stepper motor 130, the slide block 132 resting on and being slidably supported by the rail members 124. The slide block 132 might be made of a plastic material such as Nylatron (A trademark of Polymer Corp., Reading Pa.). Affixed to the top of the slide block 132, is a steel plate 123. The slide block 132 includes a clamp assembly 134 which is positionable in a clamped state for clamping the receptor material 44 between the clamp assembly 134 and the steel plate 123, wherein the receptor material 44 is moved with the slide block between first and second positions. The clamp assembly 134 is further positionable in an unclamped state so that upon completion of printing of a colored image, the receptor material 44 can be advanced past the clamp assembly 134 by the receptor material drive roller assembly 150. The range of motion of the clamp assembly 134 between the first and second positions is illustrated by the clamp assembly 134' shown in phantom line in FIG. 1, the print area 46 of the receptor material 44 lying between the first and second positions.

It will be appreciated that numerous changes may be made to the embodiment shown and yet be in keeping with the principles of the invention. One example would be the use of a receptor material takeup roll ( not shown) for rolling up the receptor material 44 after images have been printed thereon, as opposed to the use of the receptor material drive roller assembly 150 and the cutter apparatus 160.

For purposes of illustration and explanation, various components and details of the printer apparatus 40 are not shown in the diagrammatic illustration of FIG. 1. For example, in addition to other features which are not shown in FIG. 1, stepper motors which are used to drive the ribbon takeup roller assembly 110, to drive the receptor material drive roller assembly 150, and to raise and lower the print head 80 are not shown. Encoders which are used to sense movement of the platen 90, rotation of the screw 126 of the slide assembly 120, and movement of the ribbon takeup roller assembly 110 are not shown in FIG. 1. The various components may be mounted onto a vertical mounting plate 48 or any other suitable support structure. More details will be shown in the figures that follow.

As discussed, illustrated in FIG. 2 is an embodiment of the ribbon material 42 which might be used with an embodiment of the present invention. As illustrated, the ribbon material 42 includes three primary color sections, yellow 42*a*, magenta 42*b*, and cyan 42*c*. These are the three basic subtractive colors used in any subtractive color imaging. In addition the ribbon material 42 includes a black segment 42*d* having a clear segment 42*e* on either side thereof. The black segment 42*d* is used to detect the ribbon material position and the clear segments 42*e* on either side provide contrast for this process.

In operation during the printing process, the clamp assembly 134 clamps onto the receptor material 44 and advances it in the downstream direction along with the first colored section 42*a* of the ribbon material 42 past the print head 80 and the platen 90 in a juxtaposed relationship so that the color yellow is transferred to the print area 46 of the receptor material 44 which is advanced past the print head 80 along with the ribbon material 42. The ribbon material takeup roller assembly 110 operates in conjunction with the slide assembly 120 such that the ribbon material 42 advances past the print head 80 at the same rate as the receptor material 44 so that smearing of color does not occur. After transferring color from the first colored section 42*a* onto the print area 46 of the receptor material 44, the print head 80 is raised from the platen 90 and the slide assembly is moved back toward the print head such that the print area 46 of the receptor material is once again upstream of the print head 80. The dancer roller assembly 60 maintains tension on the receptor material 44 during the printing process and advances the receptor material 44 in the upstream direction as the slide assembly 120 moves in the upstream direction. The print head 80 is then lowered onto the platen 90, and the receptor material 44 is advanced past the print head 80 in the downstream direction along with the second colored section 42*b* of the ribbon material 42 so that the color magenta is transferred to the print area 46 of the receptor material 44. The receptor material 44 is then advanced once again in the upstream direction so that it can be advanced a third time in the downstream direction so as to transfer the third primary color, cyan, from the ribbon material 42 to the print area 46 of the receptor material 44.

The colored image is then complete. The print head 80 is raised. The clamp assembly 134 releases the receptor material 44 and the receptor material 44 is advanced by the receptor drive roller assembly 150 in the downstream direction to the cutter apparatus 160. If a single image is being printed, the print area 46 containing the image might be advanced from the slide assembly 120 to the cutter apparatus 160. If a series of images were being printed, the receptor material 44 might be advanced by a single print area 46 so that a previously printed print area 46 might be cut by the cutter apparatus 160 thereby minimizing the amount of receptor material 44 being used. The process of moving the ribbon material 42*a* and sensing the black segment 42*d* allows the system to calibrate all advance distances and achieve accurate positioning.

Figure 3:
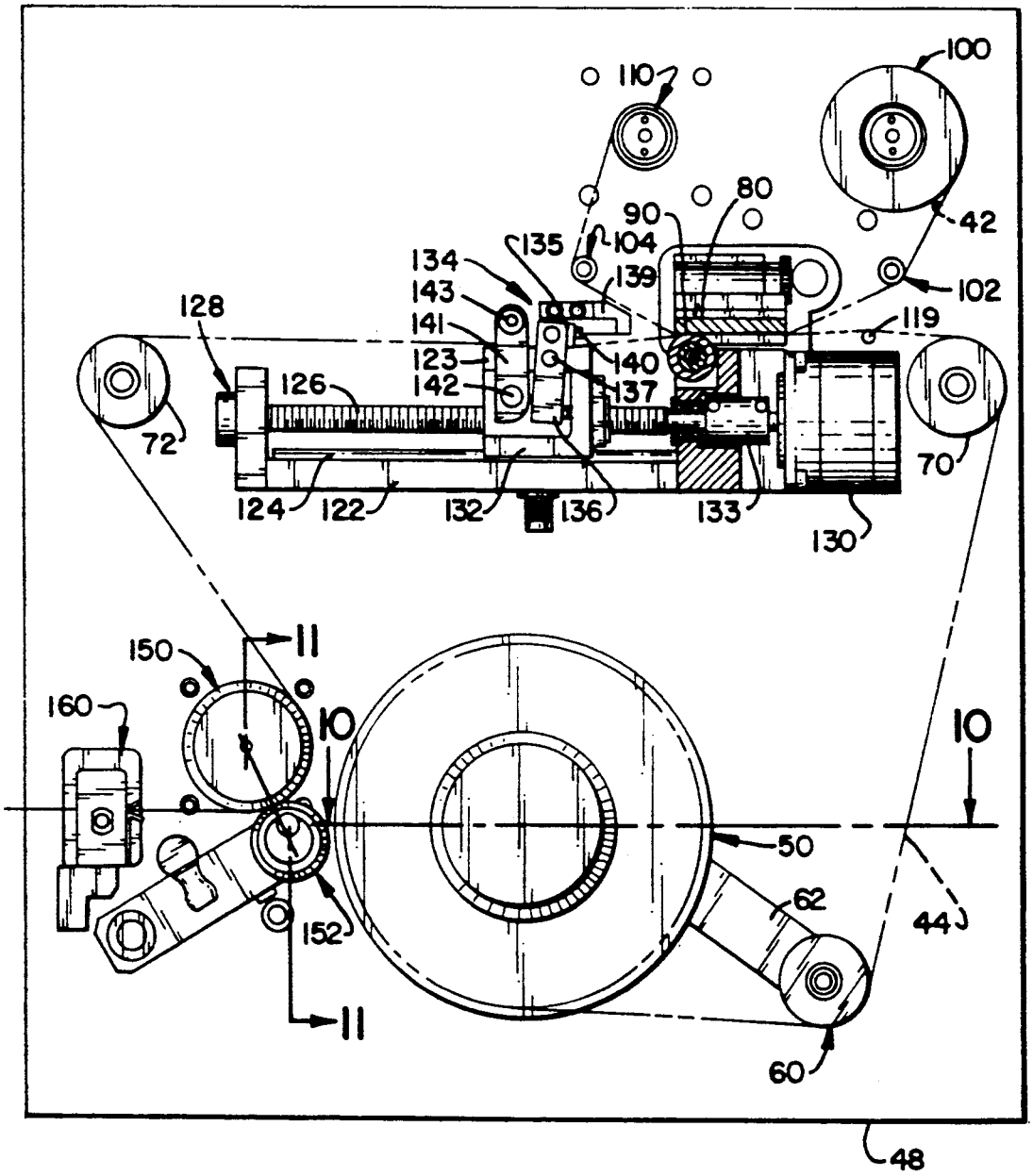
FIG. 3 is a side elevational view of the embodiment of the printer apparatus illustrated in FIG. 1, including its slide assembly, mounted on a front side of a vertical extending mounting plate.

The printer apparatus 40 will now be described in further detail. In FIG. 3, the printer apparatus 40 is illustrated as being mounted on the vertical mounting plate 48. The path of the receptor material 44 is illustrated by a phantom line as is the path of the ribbon material 42.

As shown in FIGS. 3 thru 7, the clamp assembly 134 includes a horizontally extending member 121 attached to the top of two vertically extending clamp levers 136 disposed on opposite sides of the slide block 132 and pivotally mounted to the slide block 132 for pivotal movement about a pivot point 137. In the embodiment shown, a clamp member 135 is pivotally attached to the member 121 by a projection 140 for pivotal motion from side to side about an axis extending generally longitudinally of the receptor material 44. As diagrammatically illustrated in figure 4, the clamp member 135 preferably includes spaced apart receptor material engaging surfaces 135*a* such that the receptor material 44 clamped proximate its side edges, the print area 46 lying between the surfaces 135*a*. This assures that the surfaces 135*a* will not leave any unwanted marking on the colored image. Moreover, since the clamp member 135 is pivotally attached to the member 121, the surfaces 135*a* will apply a substantially uniform clamping force on the receptor material 44. The clamp assembly 134 is biased into the clamped state by a spring 138 located between a bottom end portion of the clamp levers 136 and a slide block portion 132*a*. As diagrammatically illustrated in FIG. 5, in the clamped state, a corner portion of the surfaces 135*a* grips the receptor material 44. A clamp release member 139 is suitably mounted onto the mounting plate 48 for engaging the projection 140 on the clamp member 135 and pivoting the clamp member 135 into an unclamped state when the slide block 132 is moved into an extreme upstream position upon completion of printing of a colored image on the print area 46 of the receptor material 44. In one embodiment of the present invention, the member 121 is used to clamp onto the receptor material 44. In the unclamped state, the receptor material 44 can be readily advanced past the slide assembly 120.

A manual release lever 141 is pivotally attached at 142 to the slide block 132 and includes a knob 143 which can be readily grasped by a user so as to pivot the release lever 141 between an unreleased position wherein the release lever 141 does not engage the clamp levers 136 and a released position wherein the release lever 141 engages one of the clamp levers 136 at a location below its pivot point and pivots both of the clamp levers 136 into the unclamped state. The release lever 141 is bistable so as to remain in either of the released or unreleased positions where placed by the user.

Figure 6:
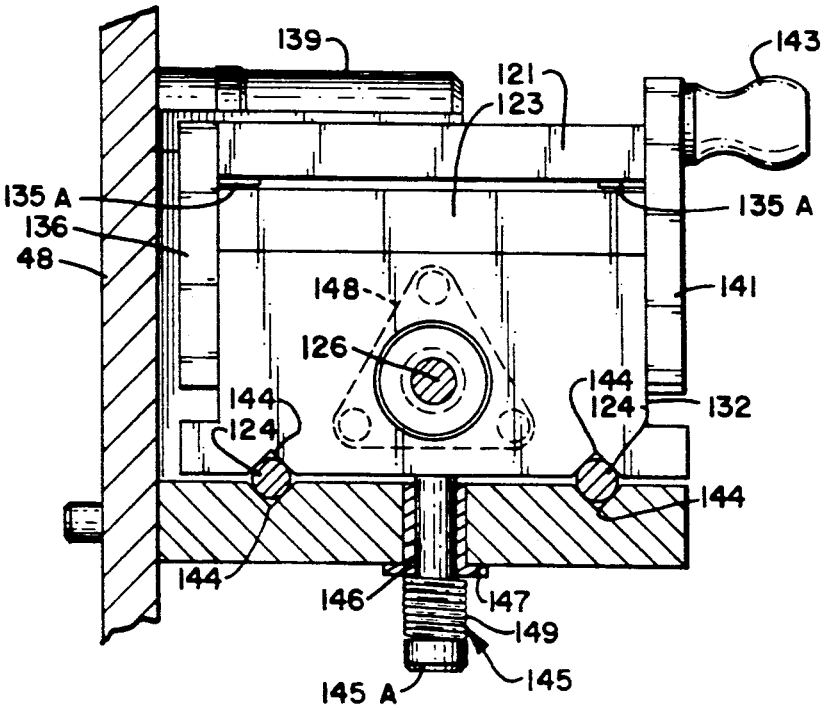
FIG. 6 is an enlarged downstream end view of the slide assembly shown in FIG. 3.

Referring in particular to FIG. 6, the slide block 132 and the base 122 include V-shaped grooves 144 which engage the cylindrical rail members 124. In alternative embodiments Thompson rods might be used to slidably support the slide assembly 120. An elongated member 145 extends vertically through a slot 146 extending longitudinally of the slide base 122 and into the slide block 132 to which it is suitably secured. A liner 147 is disposed along the member 145 to provide a wear surface highly resistant to wear such that through extended use, wobble or slop is not introduced into the system. A coil spring 148 is disposed about the elongated member 145 intermediate of an end portion 145*a* of the elongated member 145 and a shoulder portion of the liner 147. The coil spring 148 biases the slide block 132 down onto the rail members 124 by a predetermined amount of force; for example, ten pounds. Additionally, the horizontally extending, threaded screw 126 is attached to the slide block 132 by an anti-backlash attachment 149 which eliminates any wobble or slop in the interaction of the screw 126 with the slide block 132. Accordingly, the movement of the slide block 132 is very definite and precise.

Figure 7:
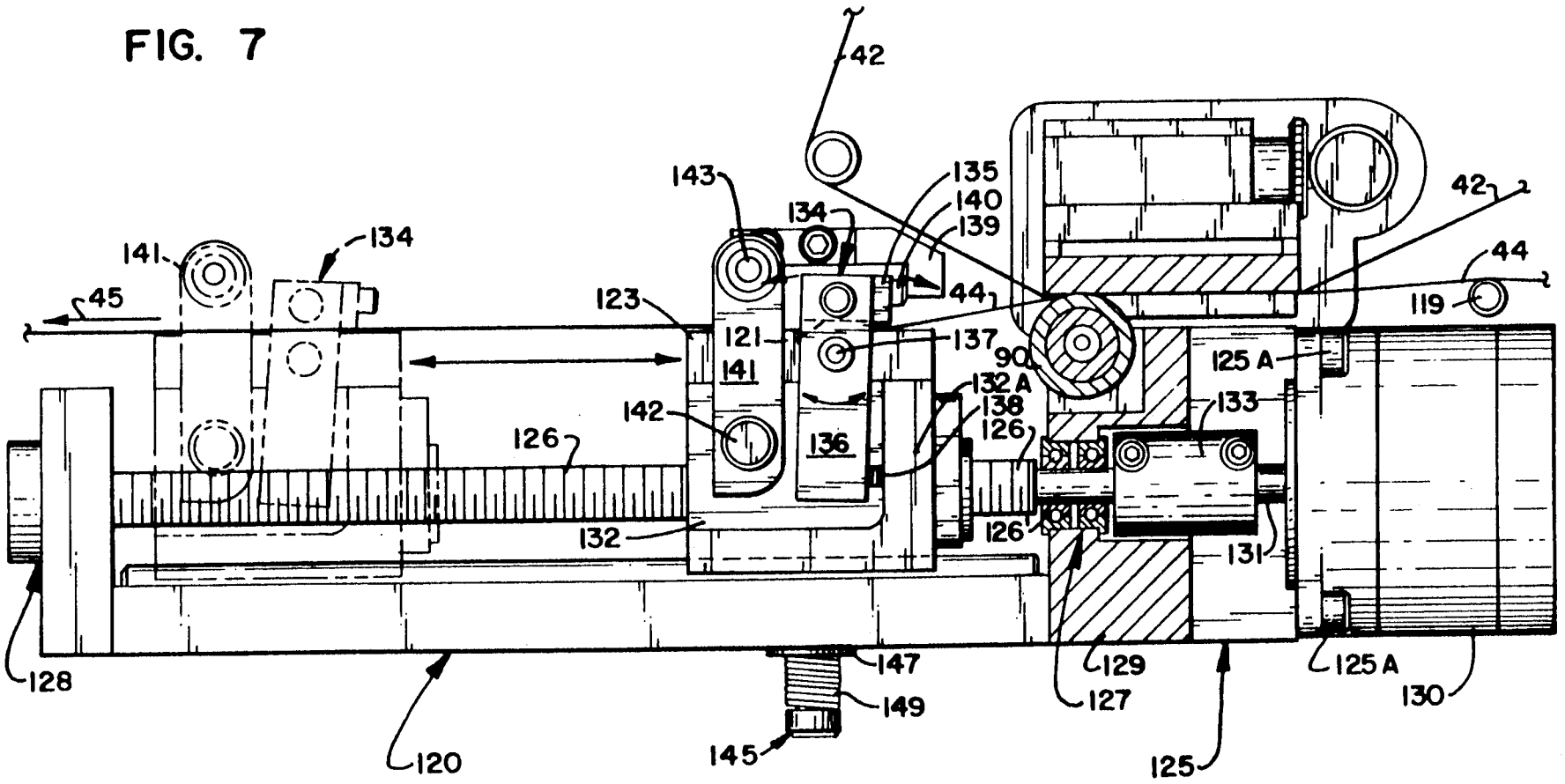
FIG. 7 is an enlarged side elevational view of the slide assembly shown in FIG. 3.

As further illustrated in FIG. 7, the stepper motor 130, which drives the screw 126, is suitably secured to an adaptor, support structure 125 by fasteners 125*a*. A drive shaft 131 of the stepper motor 130 is coupled to a non-threaded cylindrical end portion 126*a* of the screw 126 by a flexible coupling arrangement 133. This will allow for some misalignment between the elongated screw 126 and the drive shaft 131 of the stepper motor 130. A dual radial bearing 127 is provided intermediate of the coupler 133 and the threaded portion of the elongated screw 126 and is supported by a support member 129.

Figure 8:
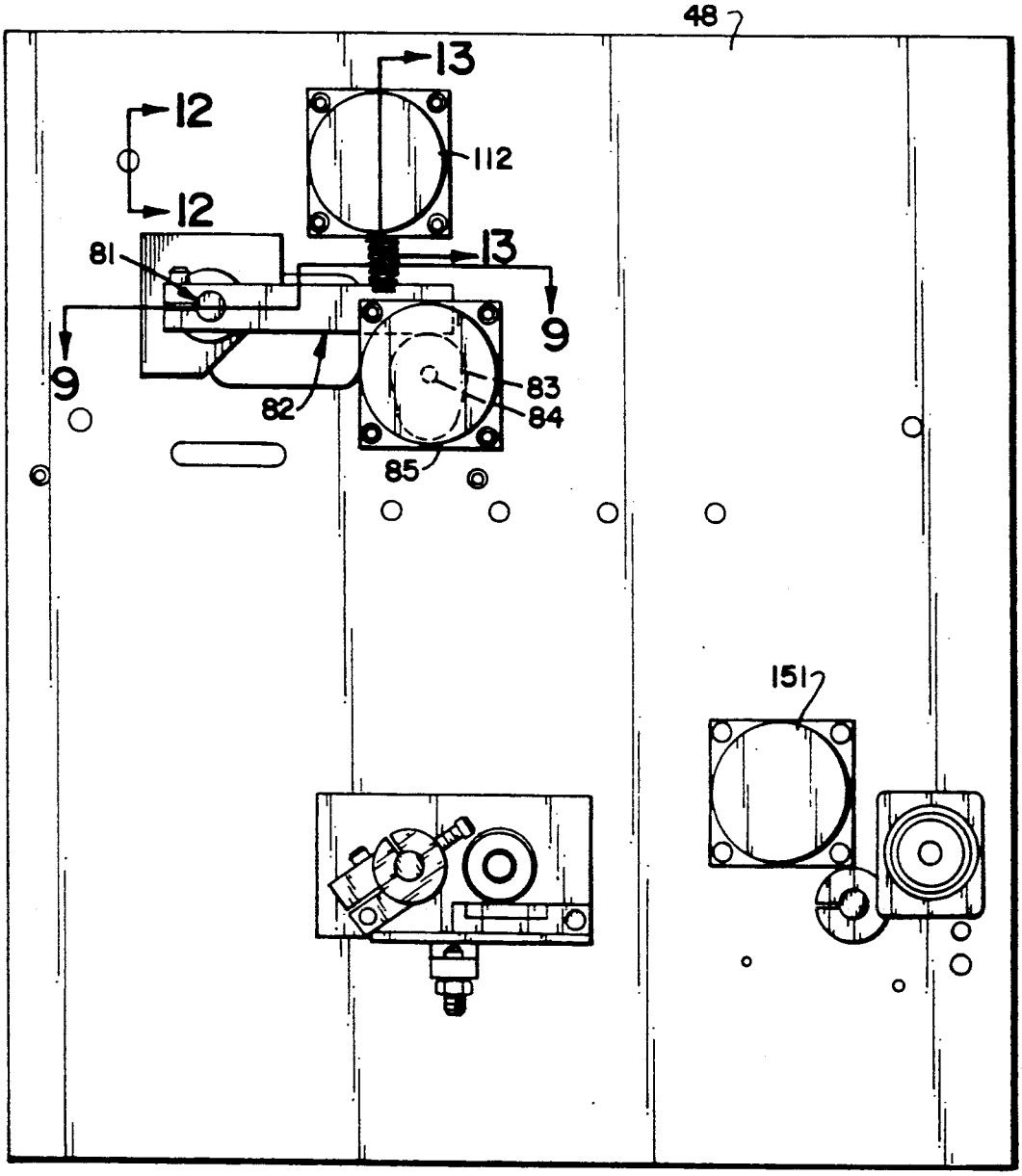
FIG. 8 is a side elevational view of a back side of the vertically extending mounting plate shown in FIG. 3.
Figure 9:
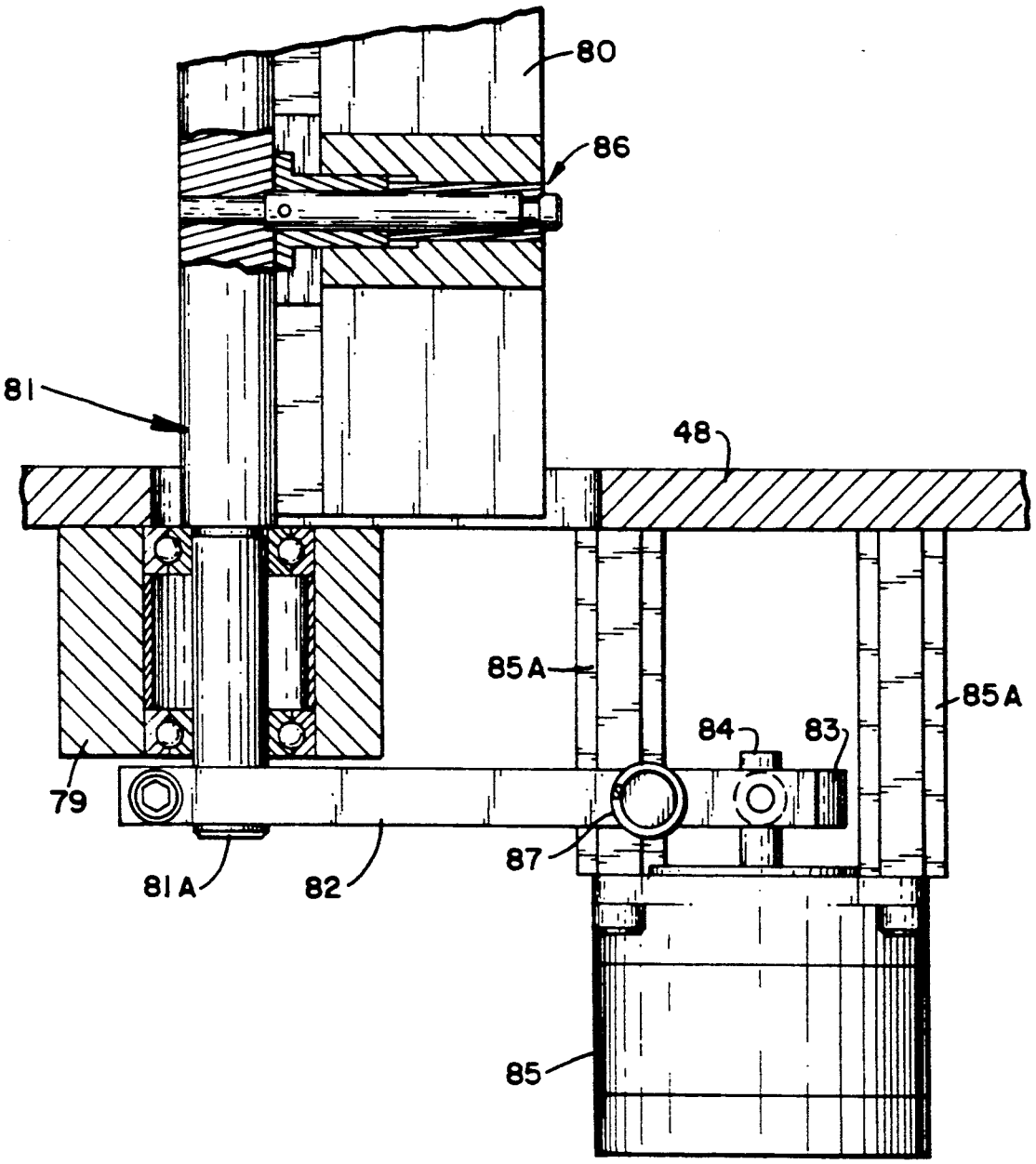
FIG. 9 is an enlarged partial sectional view as seen generally along line 9—9 of FIG. 8, illustrating a print head of the printer apparatus and its associated linkage to a stepper motor which raises and lowers the print head via a cam action.

As previously discussed, during the printing process the print head 80 is raised and lowered. This might be accomplished in any number of ways. Referring now to FIGS. 8 and 9, in the embodiment shown, the print head 80 is removably attached to a pivotable elongated shaft assembly 81. A linkage 82 is clamped at one end onto an end portion 81*a* of the shaft assembly 81 and rests on an eccentric cam 83 at its other end. The end portion 81*a* is in turn connected by a dual radial bearing support 79 to the remainder of the shaft assembly 81. The cam 83 is in turn connected to a drive shaft 84 of a stepper motor 85 for rotation with the drive shaft 84, the stepper motor 85 being shown in FIG. 9 as being attached to back side of the vertically extending support member 48 by standoffs 85*a*. Accordingly, the stepper motor 85 raises and lowers the print head 80 by pivotal movement of the cam 83. In FIG. 9, the print head 80 is illustrated being interconnected to the shaft assembly 81 by a suitable connection 86 which allows for adjustment, referred to as dot line adjustment, of the print head 80 along its horizontal axis. In the embodiment shown, the print head is not adjustable vertically; however, the print head 80 can also be raised or lowered by the cam 83. In some embodiments, the pressure applied by the print head 80 onto the platen 90 may be variably adjustable. To minimize wobble or slop in the linkage, a spring biasing arrangement 87 biases the end of the linkage 82 down onto the cam 83.

Figure 10:
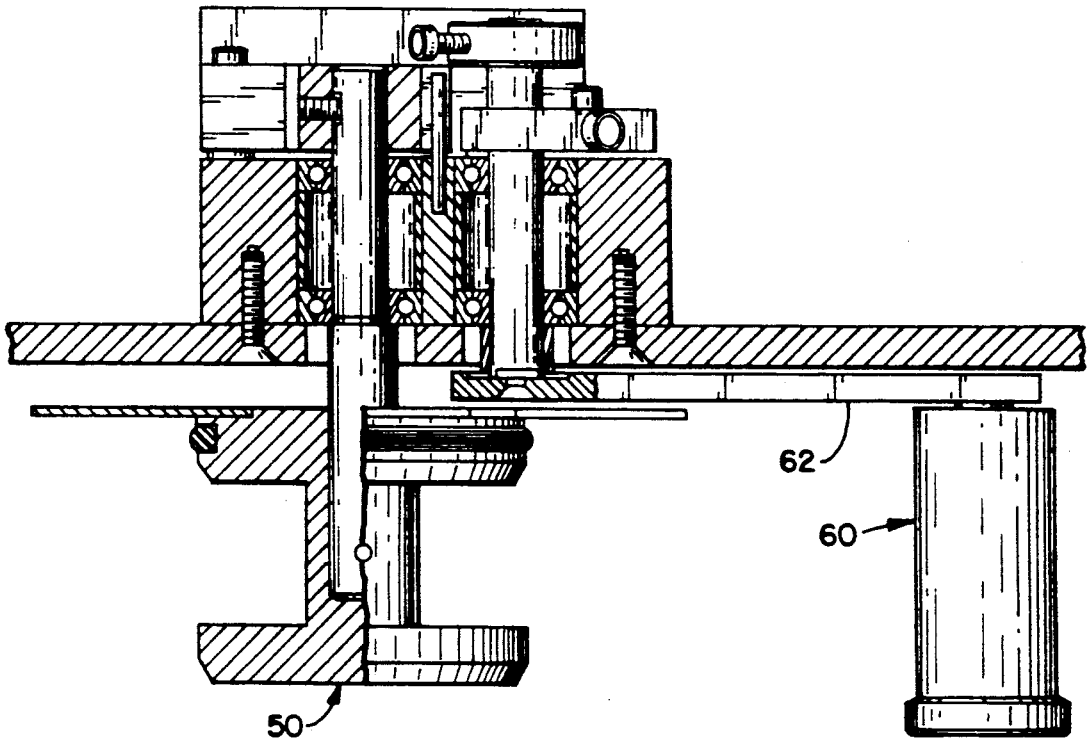
FIG. 10 is an enlarged sectional view as seen generally along line 10—10 of FIG. 3, illustrating a receptor material payoff roller assembly of the printer apparatus and its associated dancer roller assembly.

Referring now to FIG. 10 there is illustrated an enlarged partial sectional view of the receptor material payoff roller assembly 50 and its associated dancer roller assembly 60. The dancer roller assembly 60 is interconnected to the payoff roller assembly 50 by a dancer arm 62. It will be appreciated that alternative arrangements might be used to retain a uniform tension on the receptor material 44 during the printing process and insure that the receptor material 44 remains uniformly spread out and not folded or wrinkled.

Figure 11:
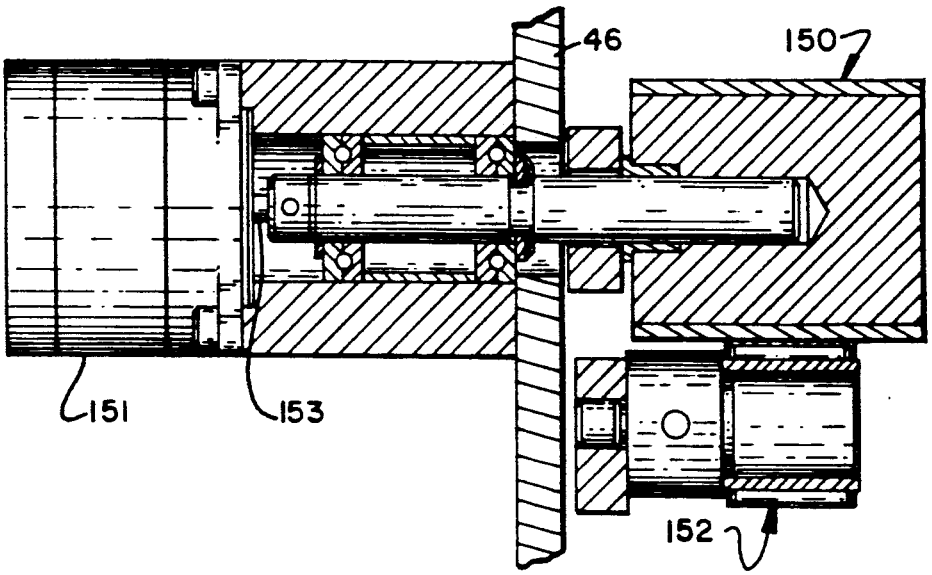
FIG. 11 is an enlarged sectional view as seen generally along line 11—11 of FIG. 3, illustrating a receptor material takeup roller assembly of the printer apparatus and its associated friction roller assembly.

Referring now to FIG. 11, there is illustrated an enlarged partial sectional view of the receptor material drive roller assembly 150 and its associated friction roller assembly 152. The drive roller assembly 150 is connected to a stepper motor 151 by a drive shaft 153.

Figure 12:
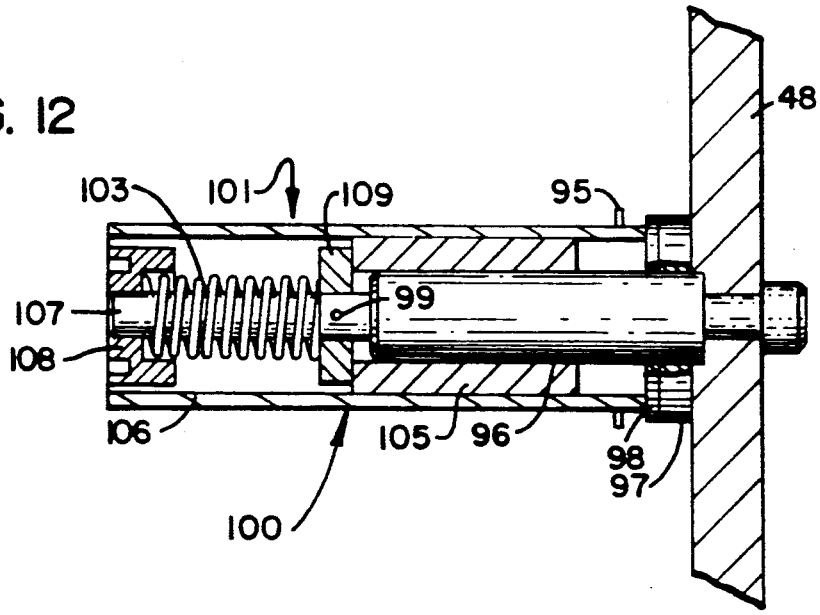
FIG. 12 is an enlarged sectional view as seen generally along line 12—12 of FIG. 8, illustrating a ribbon material payoff roller assembly of the printer apparatus.

Referring now to FIG. 12, there is illustrated an enlarged partial sectional view of an embodiment of the ribbon material payoff roller assembly 100. A spring biasing arrangement 101 is used to provide a predetermined amount of drag to the payoff roller assembly 100. This may be accomplished in any number of ways. In the embodiment shown, a resilient bearing member 105 is press fitted into a sleeve 106 and mounted onto a stationary cylindrical shaft 96 threadedly receiving an elongated threaded member 107. A spring 103 is suitably mounted about an end portion of the member 107 between a threaded member 108, threadedly mounted at the end of the member 107 and threadedly received on the end of the member 107, and a washer member 109 retained on the member 107 by a pin 99. The spring 103 forces the sleeve 106 against a stationary, friction bearing material 98, such as a rubber impregnated cork material, so as to create the drag or resistance to rotational movement. The drag can be adjusted by threadedly adjusting the threaded member 108. A collar 97 is illustrated supporting the friction material 98 at the vertical support wall 48. Projections 95 are present to prevent the ribbon material 42 from rubbing against the support plate 48.

Figure 13:
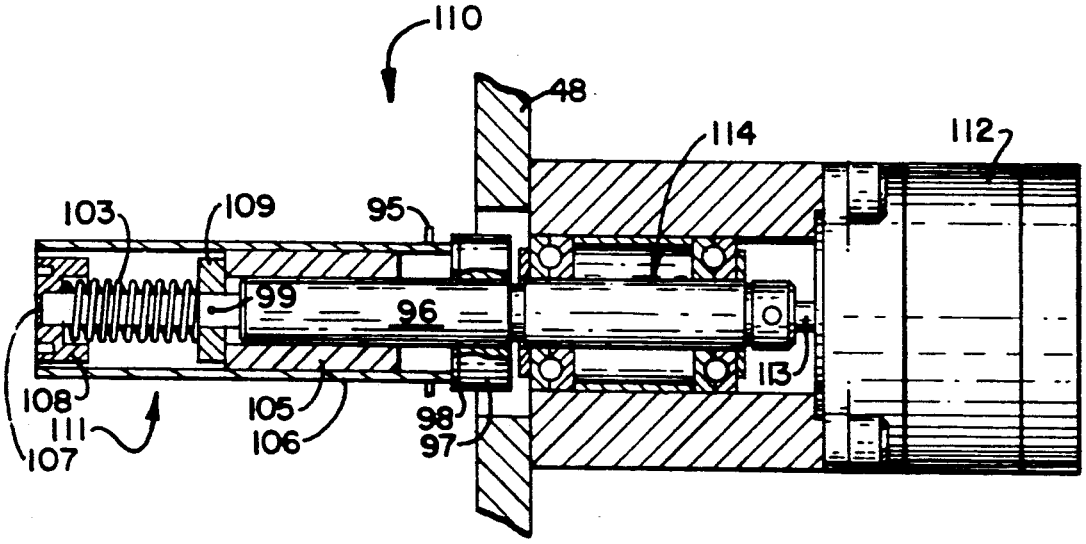
FIG. 13 is an enlarged sectional view as seen generally along line 13—13 of FIG. 8, illustrating a ribbon material takeup roller assembly of the printer apparatus.

Referring now to FIG. 13, there is illustrated an enlarged partial sectional view of an embodiment of the ribbon material takeup roller assembly 110. A spring biassing arrangement 111 similar to that used with the payoff roller assembly 100 is present (parts corresponding to FIG. 12 are referred to by like reference numerals). It will be appreciated that in this embodiment the shaft 96 and the collar 97 and their associated parts are rotatable as opposed to being stationary as in FIG. 12. The takeup roller assembly 110 is connected to a drive shaft 113 of a stepper motor 112 by a suitable connector/bearing arrangement 114 so as to be driven by the stepper motor 112. The spring biassing arrangement 111 (also referred to as a slip clutch arrangement), functions as a slip clutch which will cause the takeup roller assembly 110 to slip if it tries to takeup the ribbon material 42 at a rate faster than the ribbon material 42 is advancing with the receptor material 44. This assures that there is no relative movement between the ribbon material 42 and the receptor material 44 during the printing process. Still, the takeup roller assembly 110 is driven by the stepper motor during the printing process to insure that indeed the ribbon material 42 advances along with the receptor material 44.

Figure 14:
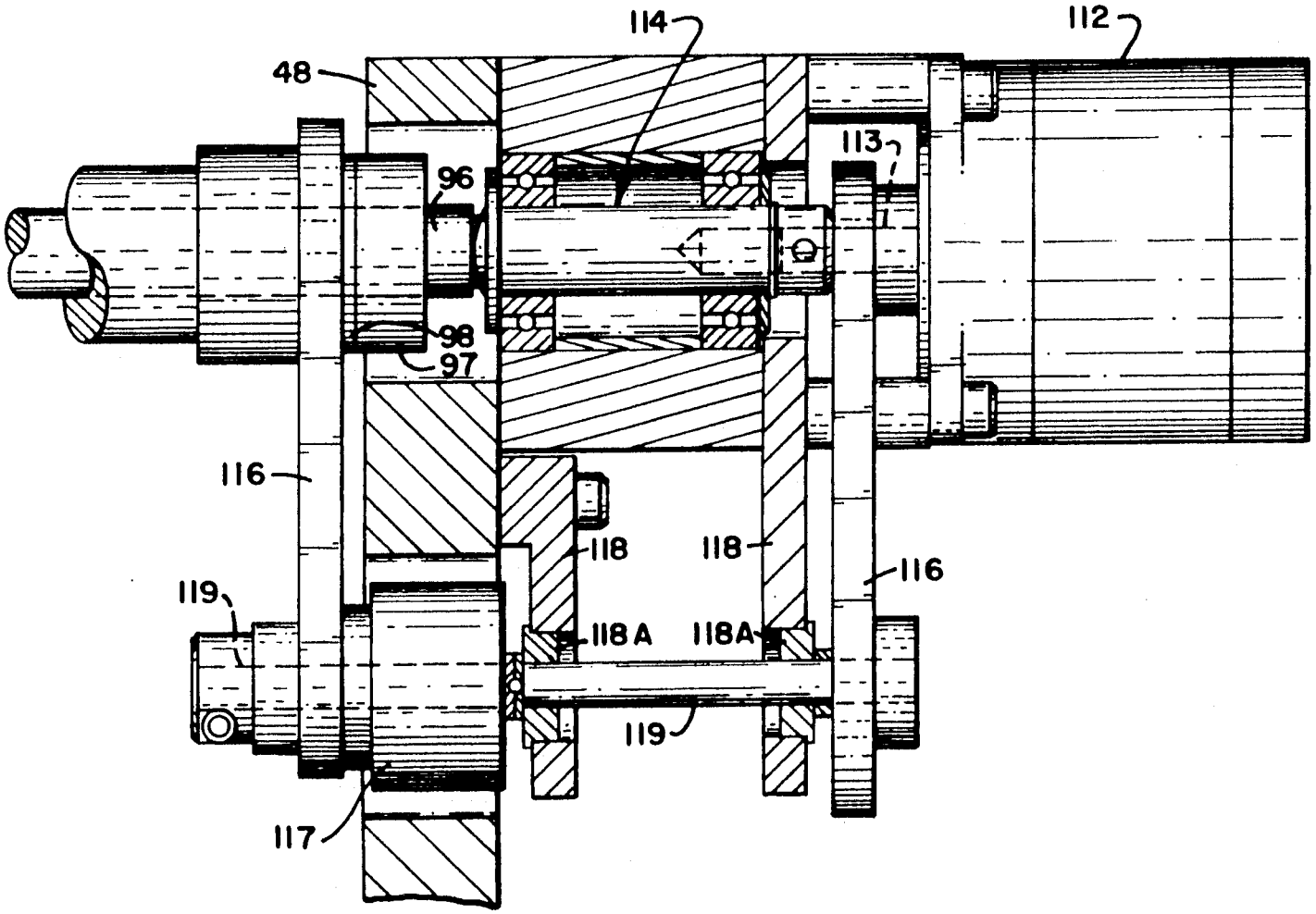
FIG. 14 is a view similar to FIG. 13 of an alternate embodiment of the ribbon material takeup roller assembly.

In the embodiment shown in FIG. 13, the stepper motor 112 is used both to advance the ribbon material 42 during the printing process and to advance the ribbon material 42 to the next color section on the ribbon material between printing intervals. Illustrated in FIG. 14, is an alternate embodiment wherein the stepper motor 112 is directly connected to the ribbon takeup roller assembly 110 so as to bypass the slip clutch arrangement 111 and directly drive the takeup roller assembly 110 when advancing the ribbon material 42 to the next color section. This will assure that when advancing the ribbon material 42, the roller assembly 110 will not experience any slippage. The stepper motor 112 is mechanically connected by two timing belts 116 and includes a solenoid activated clutch arrangement 117 such that the upon activation of the solenoid clutch arrangement 117, the stepper motor 112 would be directly driving the roller assembly 110. Upon deactivation of the solenoid clutch arrangement, the stepper motor 112 would again be operating in its normal mode. Suitable support structure 118 with bearings 118*a* is provided for supporting a shaft assembly 119 driven by the timing belts 116. Yet another embodiment might utilize a separate stepper motor suitably directly connected to the roller assembly 110 for advancing the ribbon from one color section to the next.

As discussed the spring biasing arrangement or slip clutch arrangement 111 of the takeup roller assembly 110 insures identical travel of the ribbon material 42 and the receptor material 44. Ribbon material advance is coupled to receptor material advance by the friction between the ribbon material 42 and the receptor material 44 created by the pressure applied by the print head 80 on the platen 90. In addition, there is a coupling or adherence caused by the printing process.

In a preferred embodiment, the speed of rotation of the takeup roller assembly 110 is adjusted to compensate for the increasing size or diameter of the roll of ribbon material on the takeup roller assembly 110 so that slippage of the takeup roller assembly 110 is reduced to a minimum. This prevents the ribbon material 42 from applying an upward and/or forward force on the print head 80, due to the slip clutch arrangement 111 intermittently engaging and jerking on the ribbon material 42. As a result variations in print quality due to dot line mis-registration (caused a pull forward) or due to pressure variations (caused by a pull upward) are minimized or eliminated. The takeup roller assembly 110 takes up the ribbon material 42 at a rate substantially the same as the rate at which the receptor material 44 is being advanced in the downstream position during the printing process.

In the embodiment shown, the stepper motor 112 which drives the ribbon material takeup roller assembly 110 is a 400 step/revolution stepper motor which can be operated in increments of one-half step as well as a full step. In this embodiment, the stepper motor 112 is operated in its one-half step mode. In order to couple the ribbon material 42 movement to the receptor material 44 movement, the stepper motor 112 advances the ribbon material 42 one-half step for every N steps of the threaded screw stepper motor 130 wherein one full step represents a linear movement of 0.0004167" and wherein N is an integer value from 1 to 255. The value of N is chosen to minimize clutch slippage of the takeup roller assembly 110. As the ribbon material 42 builds up on the takeup roller assembly 110, the value of N changes. A 800 pulse per revolution encoder 186 is mounted to the roller 102, which is a 1.5" idler roller, in the ribbon material path. The roller 102 preferably has a surface; e.g., silicon, which assures sufficient adherence between the roller 102 and the ribbon material 42 such that the roller 102 will roll or rotate with movement of the ribbon material 42. Thus as the roller 102 rotates, the encoder 186 provides a readout of the distance traveled by the ribbon material 42. In the embodiment shown, one pulse of the encoder 186 equals a linear movement of 0.00589 inches.

Figure 15:
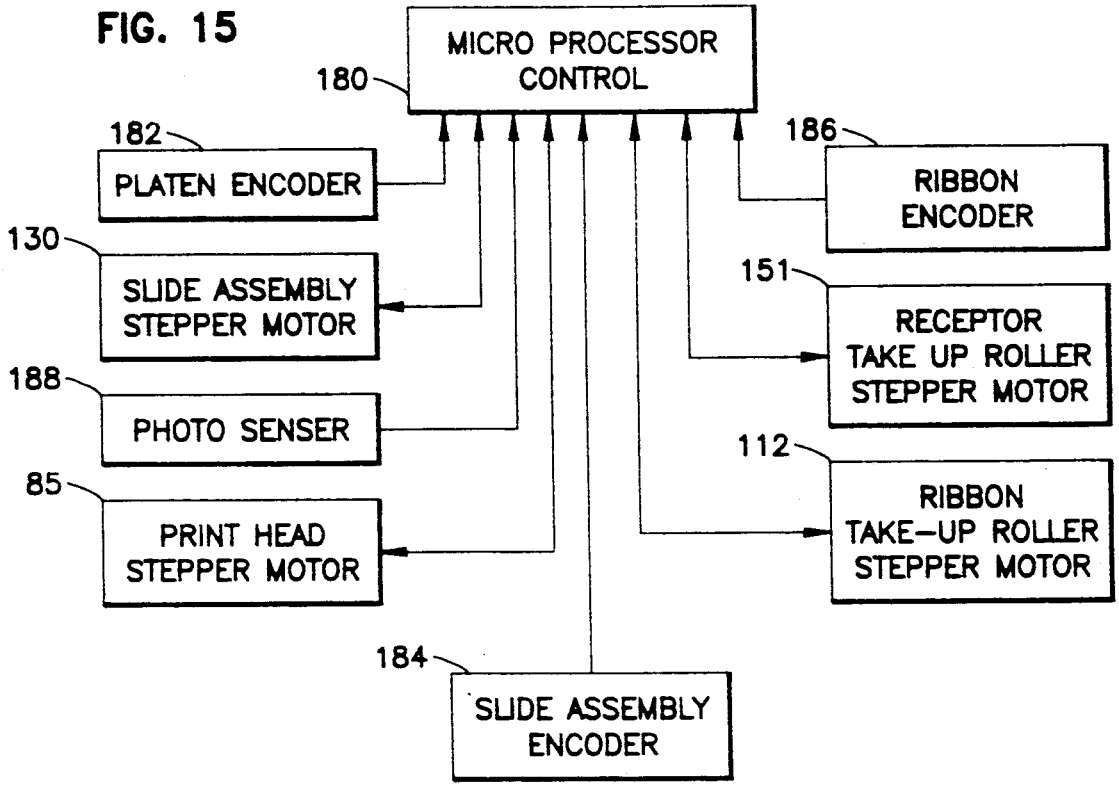
FIG. 15 is a block diagram illustrating interconnection of a microprocessor controller of the printer apparatus with various stepper motors, encoders, and other operational elements of the printer apparatus transmitting and/or receiving electrical signals to and/or from the microprocessor controller.

Referring now to FIG. 15, when advancing the ribbon material 42 to the next color section after printing the previous section, the takeup roller assembly 110 is directly driven by the direct drive stepper motor 112, which in the embodiment shown, is a 200 step/revolution stepper motor. During this advance, the number of steps, referred to as ribbon steps, of the stepper motor 112 are totalled. At the same time, the number of encoder pulses from the encoder 186 are totalled. The new value of N is then calculated as follows:

$$N = \frac{\text{Ribbon Steps} * 0.00589}{\text{Encoder Pulses} * 0.0004167 * 2}$$

(It will be appreciated that the specific values will change in alternate embodiments.)

Rounding to the nearest integer, this equation can be roughly expressed as:

$$N = \frac{7 * \text{Ribbon Steps}}{\text{Encoder Pulses}}$$

As can be seen from the above disclosure, very careful attention is given throughout the design of the present invention to insure accurate, high resolution printing. In addition to other considerations, the slide assembly 120 is driven by a threaded screw 126, stepper motors are used to drive moving parts, encoders are used to sense movement, uniform tension is maintained on the receptor material 44, the ribbon material 42 and the receptor material 44 are moved at the same rate past the print head 80, wobble or slippage in any linkages is minimized, parts are manufactured with very minimal tolerances, etc. As a result a very crisp, clear image with a very great detail can be produced. Resolution on the order of 200 to 300 dots per inch has been obtained in some tests.

It will be appreciated that various commercially available receptor materials, ribbon materials, and print heads might be used with the present invention. For example, KST and KMT print heads from Kyocera, ribbon/receptor media from ICI, Kodak or Dai Nippon Printing, etc. are commercially available. Various other print heads made by Hitachi, Rohm and Kyocera might be used with the present invention. Receptor material sold under the product name, D2T2, by ICI of Essex, England might be used. Kodak Video Color Ribbon Package SV100 series might be used. In addition, the varying dimensions of the ribbon material 42, the receptor material 44, and the roller assemblies may be used, etc. For example, the width of the ribbon material might be 2½", 8", etc Illustrated in FIG. 15, is an overall system block diagram. The printer apparatus of the present invention includes a microprocessor controller 180. The microprocessor controller 180 is electrically connected to the various encoders of the printer apparatus including: encoder 182 associated with the platen 90 for monitoring movement of the receptor material 44, encoder 184 associated with the screw 126 of the slide assembly 120 for monitoring movement of the slide assembly 120, and the encoder 186 associated with the ribbon roller 102 for monitoring movement of the ribbon material 42. The encoders send electrical signals or pulses to the microprocessor controller 180 which are representative of such movement. Based on the signals received, the microprocessor controller 180 is programmed to direct operation of the various stepper motors used in the printer apparatus 40. A photo sensor 188 suitably mounted adjacent the path of the ribbon material 42 is electrically connected to the microprocessor controller 180. The photo sensor 188 senses the black section **42*d* on the ribbon material 42 and sends an electrical signal to the controller 180 indicating detection of this section. In the embodiment shown, the photo sensor 188 is located such that upon detection of a leading edge of the black section 42*d*, a leading edge of the yellow section 42*a* is located under the print head 80. Upon start-up, the ribbon material 42 is advanced at least three full color sections so that the controller 180 can calibrate the length of the individual color sections. Calibrated are the number of ribbon stepper motor steps taken to drive the ribbon material 42 from one black segment 42*d*** to another, along with the known length of each color segment, are used to compute total distance, plus the distance of each color segment in units of stepper motor steps.

Figure 16:
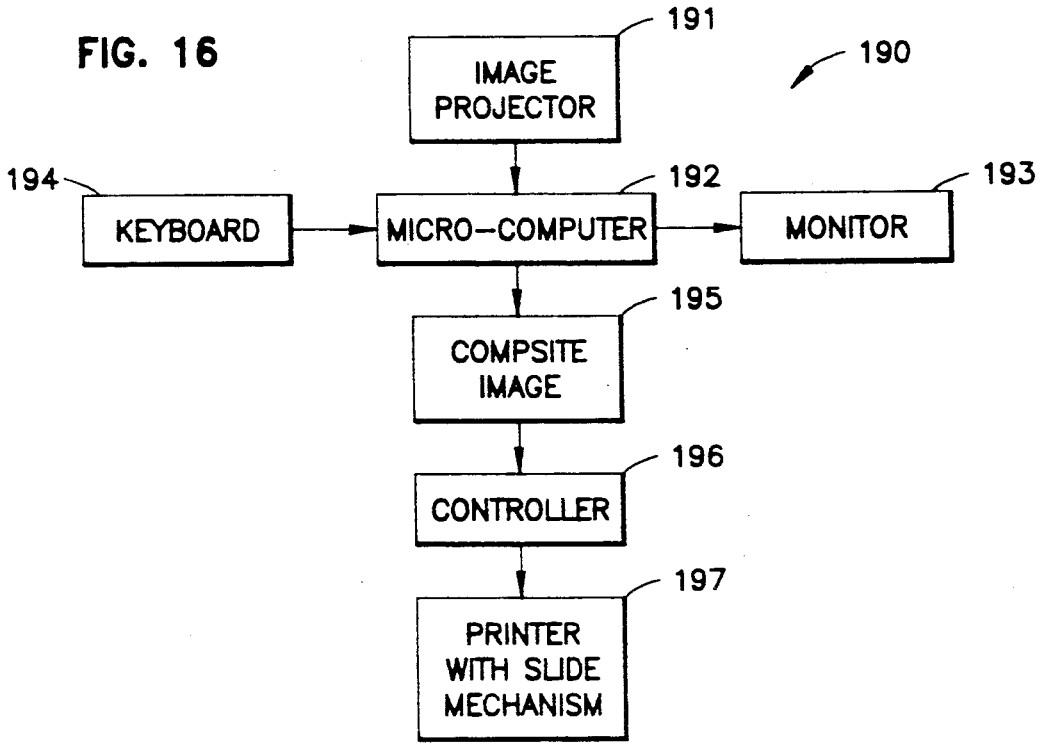
FIG. 16 is a block diagram illustrating operation of an overall imaging system using the printer apparatus of the present invention.
Figure 17:
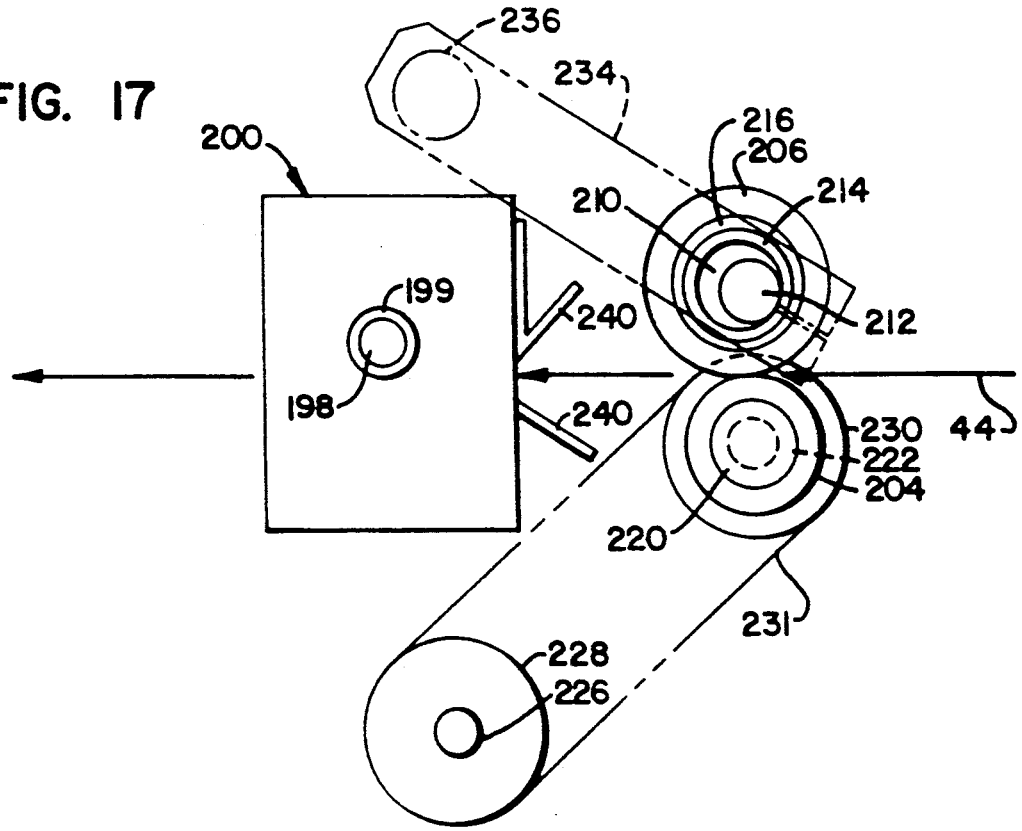
FIG. 17 is a diagrammatic view of an alternate embodiment of the present invention wherein the cutter apparatus is mounted on the slide block of the slide assembly and the receptor material clamping mechanism includes a pair of cooperating rollers also mounted on the slide block.
Figure 18:
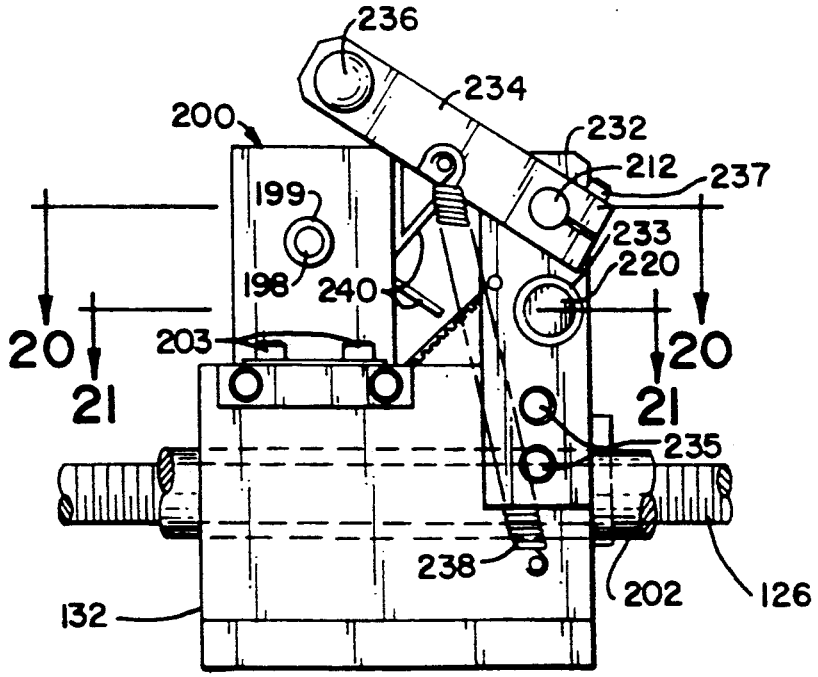
FIG. 18 is a side elevational view of the embodiment illustrated in FIG. 17.
Figure 19:
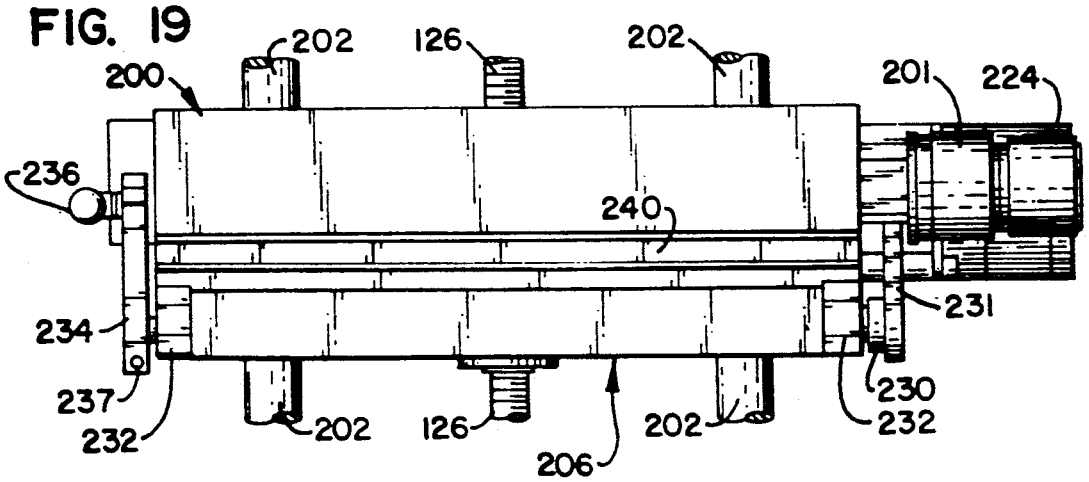
FIG. 19 is a top plan view of the embodiment shown in FIG. 18.
Figure 20:
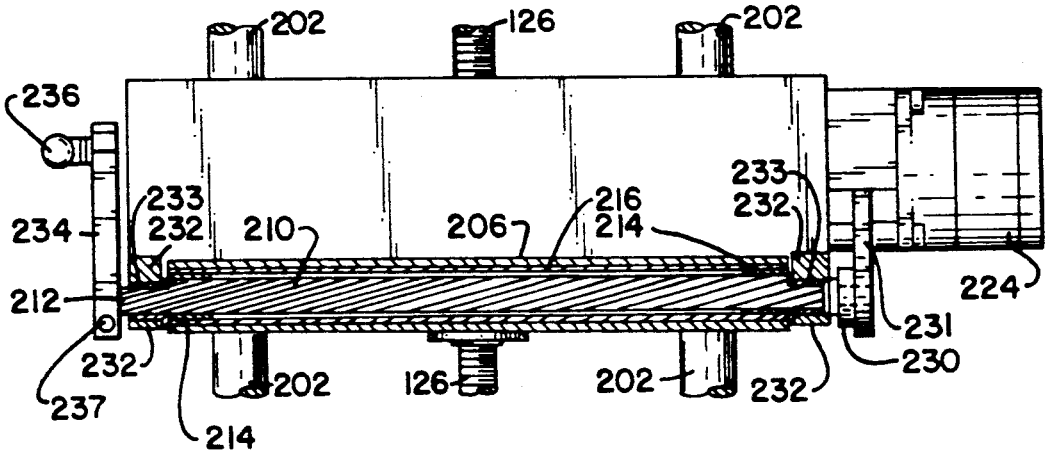
FIG. 20 is view of the embodiment shown in FIG. 18 as seen general along the line 20—20 of FIG. 18.
Figure 21:
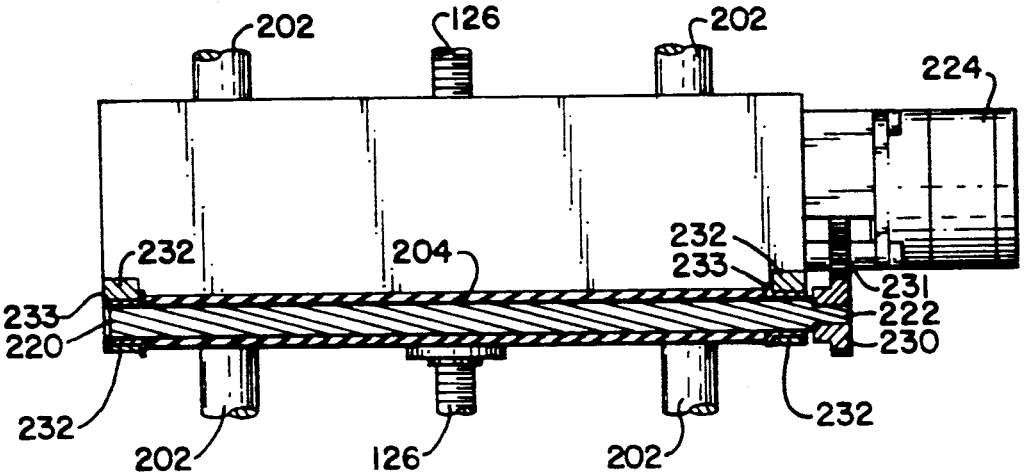
FIG. 21 is a view of the embodiment shown in FIG. 18 as seen generally along the line 21—21 of FIG. 18.

Illustrated in FIG. 16 is a block diagram of an embodiment of an imaging processing system 190 utilizing the printer apparatus 40 of the present invention. Image data to be printed on the receptor material 44 is obtained from a suitable source such an image projector 191. The image might be a person's picture, a bar code, logo design, etc. The image data is then fed to a computer 192 such as an IBM compatible AT microcomputer. The user might then edit, modify, convert, store, etc. the data by use of a monitor 193 and keyboard 194. At block 195, the user makes the total composite image utilizing a composite of image and other data which is desired to be printed on the receptor material 44. At block 196, the data to be printed is transferred to the printer controller of the printer apparatus 40 and at block 197 the data is printed at a printer apparatus 40.

In alternate embodiments of the invention, the slide assembly 120 might be used to move the print head 80 as opposed to the receptor material 44. In this configuration, the receptor material 44 remains stationary for three passes of the printer, and then the receptor material 44 is advanced.

Illustrated in FIGS. 17 thru 21 is yet another alternate embodiment of a printer apparatus 40 wherein a cutter apparatus 200, such as a conventional rotary cutter, is suitably mounted on the slide block 132 by fasteners 203. A blade of the cutter apparatus 200 is rotably supported by a shaft 198 and bearing arrangement 199. The cutter apparatus 200 is driven by a suitable motor 201 suitably interconnected to the cutter apparatus 200 and mounted on the slide bock 132 for movement therewith. In this embodiment, the slide block 132 is slidably mounted on Thompson rods 202 and is driven by the threaded screw 126. This embodiment is particularly advantageous when printing a single image at a time so as to not waste receptor material 44.

In the printer apparatus shown, clamping of the receptor material 44 is accomplished by two, parallel rollers 204 and 206 which clamp onto the receptor material 44. The roller 206 is mounted on an eccentric shaft 210. Two sleeve bearings 214 and 216 are present to permit the neoprene roller 206 to rotate about the eccentric shaft 210. The bottom feed roller 204 is mounted on a concentric shaft 220. The feed roller 204 is driven by a stepper drive motor 224. A drive shaft 226 of the stepper motor 224 has a gear arrangement 228 which is interconnected to a gear arrangement 230 mounted on the shaft 220 by a timing belt 231. The stepper motor 224 is mounted on the slide block 132 for movement therewith.

Both of the roller shafts 210 and 220 have end portions 212 and 222, respectively, which are rotatably supported by bearings 233 disposed in vertically extending uprights 232 mounted on either side of the slide block 132 by fasteners 235. The top eccentric shaft portion 212 has a lever 234 fixedly clamped thereto by a threaded member 237. A handle 236 is mounted on the end of the lever 234. A spring 238 is attached to the lever and to the slide block 132 for biasing the lever 234 down so that the roller 206 correspondingly biased into a clamped position clamping the receptor material 44 between the rollers 206 and 204. Moving the lever 234 up will rotate the shaft 206 and thus create a gap between the rollers 206 and 204 such that the receptor material 44 can be loaded between the rollers 206 and 204. Upon release of the lever 234, the lever 234 will be biased downward thereby causing the receptor material to be clamped between the rollers 206 and 204.

In use, as with the other embodiments, the slide block 132 will be driven forward and back for three passes as required for printing an image on the receptor material 44. After the final forward pass, with the image being located upstream of the rollers 206 and 204, the drive stepper motor 224 is started so as to rotate the drive roller 220. Upon rotation of the drive roller 220, the receptor material 44 is advanced into and through the cutter apparatus 200. Guide members 240 facilitate guiding the receptor material 44 into the cutter apparatus 200. As the receptor material 44 is being advanced, the roller 206 is caused to rotate by movement of the receptor material 44. Once the image is moved downstream of the cutter apparatus 200, the cutter motor 201 is started to activate the cutter apparatus 200 and cut the receptor material at a location upstream of the image. It will be appreciated that this embodiment minimizes waste because the cutter apparatus 200 is mounted on the slide block 132 adjacent the rollers 206 and 204. Thus, when printing single images, the only portion of the receptor material 44 not used is that which is located between the cutter apparatus 200 and the location where the next image starts.

It will be appreciated that the printer apparatus has numerous applications. Printing of a person's image on an identification card, printing of a bar code, printing of logos on credit cards or the like, photographic proof printing, medical and scientific image printing, printing and publishing proof printing, computer aided graphics hard copy, presentation graphics and transparency printing, graphic arts printing, production printing as well as on demand printing, etc. are but a few of the many applications of the printer apparatus 40 of the present invention.

It is to be understood, that even though numerous characteristics and advantages of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad general meaning of the terms in which the appended claims are expressed.

What is claimed is:

1. An improved printer apparatus, comprising:

receptor material supply means for supplying a receptor material;

ribbon supply means for supplying a ribbon material, the ribbon material including a plurality of different colored sections, reoccurring in a repetitive pattern;

a print head and platen arrangement, the receptor material and the ribbon material extending intermediate of the print head and the platen in a juxtaposed relationship with the print ribbon being disposed intermediate of the receptor material and the print head;

means for advancing the receptor material; and a ribbon material takeup roller assembly having means to advance the ribbon material, the roller assembly including slip clutch drive means for permitting advancement of the ribbon material during the printing process when tension on the ribbon material is less than a predetermined value and the roller assembly further including direct drive means bypassing the slip clutch means for permitting advancement of the ribbon material from one colored section to the next.

2. An apparatus according to claim 1, wherein the ribbon material takeup roller assembly includes a solenoid motor interconnected to a takeup roller of the ribbon material takeup roller assembly by two different linkages, one of said linkages including the slip clutch means and the other of said linkages including the direct drive means bypassing said slip clutch means.

3. An apparatus according to claim 1, wherein the ribbon material takeup assembly is driven by a first stepper motor during the printing process and a second stepper motor when advancing the ribbon material form one color section to the next.

4. An apparatus according to claim 1, including control means for rotating the ribbon material takeup roller assembly at variable speeds.

5. An apparatus according to claim 4, wherein the ribbon material takeup roller rotation rate is varied as an increasingly greater amount of the ribbon material is taken up.

6. An apparatus according to claim 5, wherein the rate of advance of the ribbon material is sufficient to takeup the ribbon material.

7. An apparatus according to claim 4, further including sensor means for sensing speed at which the ribbon material is being advanced by the ribbon material takeup roller when the ribbon material is advanced from one color section to the next, the control means being electrically connected to said sensor means for receiving electrical signals from the sensor means representative of the speed at which the ribbon material is being advanced by the ribbon material takeup roller assembly, the control means including program means for processing the electrical signals and determining the rate at which the ribbon material takeup roller assembly should be rotated.

8. An apparatus according to claim 1, wherein the print head is adjustably mounted so as to enable dot line adjustment of the print head.

9. An apparatus according to claim 1, wherein the means for advancing the receptor material includes a generally U-shaped clamp for engaging the receptor material, the U-shaped clamp, being mounted for pivotal motion about an axis extending generally longitudinally of the receptor material.

10. An apparatus according to claim 1, further including cutter means for cutting off an end portion of the receptor material.

* * * * *

UNITED STATES PATENT AND TRADEMARK OFFICE

CERTIFICATE OF CORRECTION

PATENT NO. : 5,080,512

DATED : January 14, 1992

INVENTOR(S) : Schofield et al.

It is certified that error appears in the above-identified patent and that said Letters Patent is hereby corrected as shown below:

Title Page: -- Item [75]: Inventors:
INSERT --Chris Rothwell, Warwick-- after the word "Tiverton,".

Column 1, line 36
INSERT ":" after the word "including".

Column 3, line 14
INSERT "a" after the word "is".

Column 3, line 15
DELETE "general" and INSERT therefor --generally--.

Column 3, line 53
DELETE "in" and INSERT therefor --is--.

Column 4, line 11
DELETE "of" after the word "cutting".

Column 4, line 31
INSERT --,-- after the word "Reading".

Column 4, line 52
INSERT --,-- after the word "(not shown)".

Column 7, line 29
INSERT --the-- after the word "to".

Column 8, lines 19 and 28
DELETE "biassing" and insert therefor --biasing--.

UNITED STATES PATENT AND TRADEMARK OFFICE

CERTIFICATE OF CORRECTION

PATENT NO. : 5,080,512

DATED : January 14, 1992

INVENTOR(S) : Schofield et al.

It is certified that error appears in the above-identified patent and that said Letters Patent is hereby corrected as shown below:

Column 9, line 46
INSERT --,-- after the word "Thus".

Column 11, line 29
DELETE "rotably" and insert therefor --rotatably--

Column 13, claim 3
DELETE "form" and insert therefor --from--.

Signed and Sealed this

Fourteenth Day of December, 1993

Bruce Lehman

*Attest:*

BRUCE LEHMAN

*Attesting Officer*

*Commissioner of Patents and Trademarks*